United States Patent [19]

Eberhardt et al.

[11] Patent Number: 4,976,319

[45] **Date of Patent: * Dec. 11, 1990**

[54] WATER DRIVEN FAN FOR FIREFIGHTING

[75] Inventors: H. Alfred Eberhardt, Paoli; Richard E. Teske, Norristown, both of Pa.

[73] Assignee: Hale Fire Pump Company, Conshohocken, Pa.

[ * ] Notice: The portion of the term of this patent subsequent to Mar. 13, 2007 has been disclaimed.

[21] Appl. No.: 319,548

[22] Filed: Mar. 6, 1989

[51] Int. Cl.[5] ..... A62C 29/00

[52] U.S. Cl. ..... 169/54; 169/91; 169/15; 169/70; 239/14.2; 239/2.2; 239/242

[58] Field of Search ..... 169/70, 54, 91, 15, 169/14.2, 46, 5; 239/380, 381, 382, 383, 14.2, 240, 241, 242, 205, 446, 2.2, 37, 337, 398; 98/30, 1, 12, 17, 100, 109

[56] References Cited

U.S. PATENT DOCUMENTS

| | | | |
|---|---|---|---|
| 1,055,411 | 3/1913 | McWilliams et al. | 239/214.25 |
| 3,428,131 | 2/1969 | Winslow | 239/251 |
| 4,182,347 | 1/1980 | Russo | 128/725 |
| 4,513,604 | 4/1985 | Frantz et al. | 73/39 |
| 4,682,729 | 7/1987 | Doman et al. | 239/14.2 |
| 4,813,598 | 3/1989 | Kosik, Sr. et al. | 239/14.2 |

*Primary Examiner*—Joseph F. Peters, Jr.
*Assistant Examiner*—Christopher P. Ellis
*Attorney, Agent, or Firm*—Frank A. Follmer

[57] ABSTRACT

A portable water driven fan for firefighting applications utilizing positive pressure ventilation is disclosed. A unit including a water powered turbine and a fan is constructed to be light in weight and compact and is capable of delivering a large volume of air sufficient for positive pressure ventilation. The unit is provided with a plurality of spray nozzles which enables the unit to deliver a water mist along with the air.

24 Claims, 7 Drawing Sheets

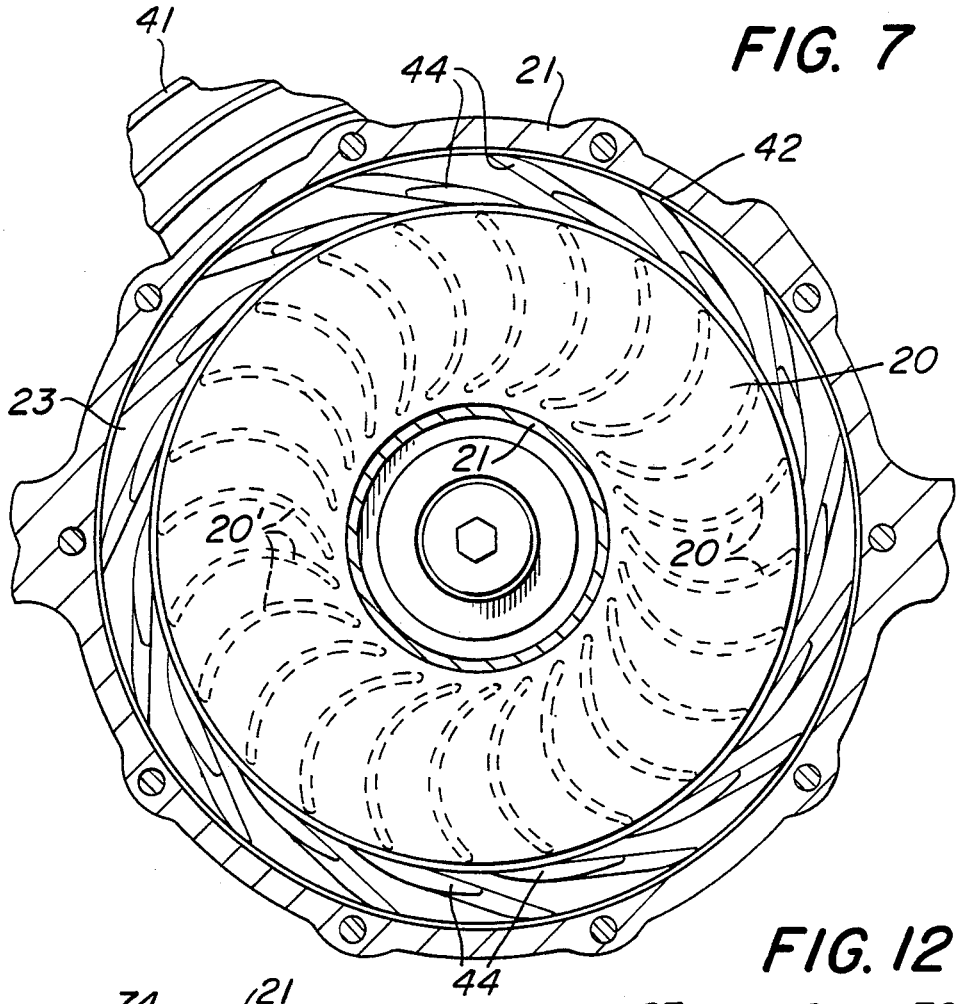
FIG. 7
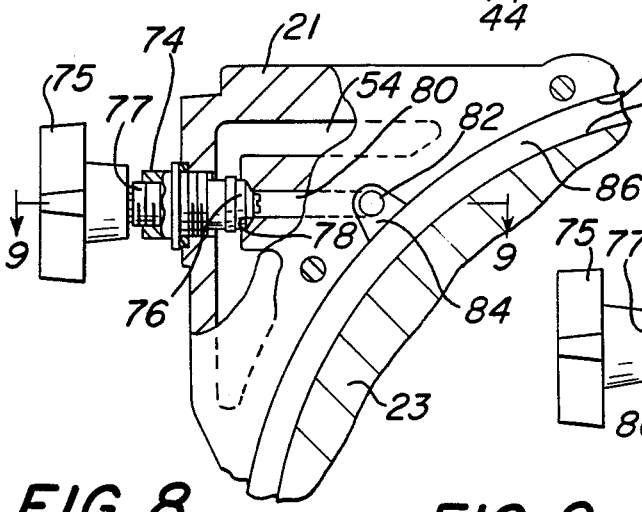
FIG. 8
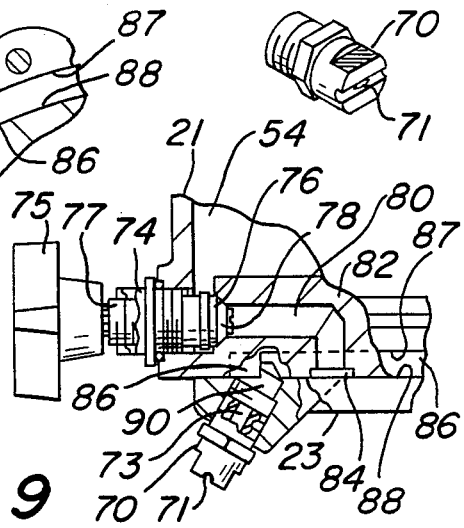
FIG. 12
FIG. 9

FIG. 10
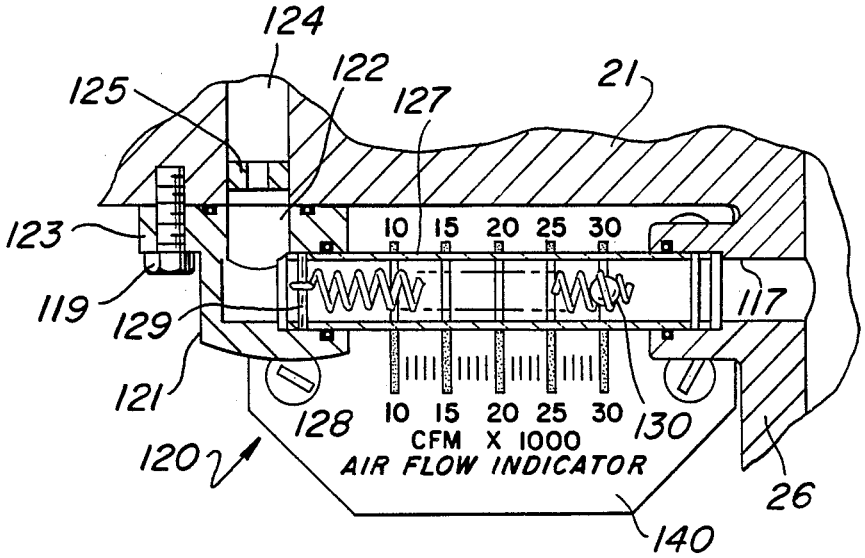
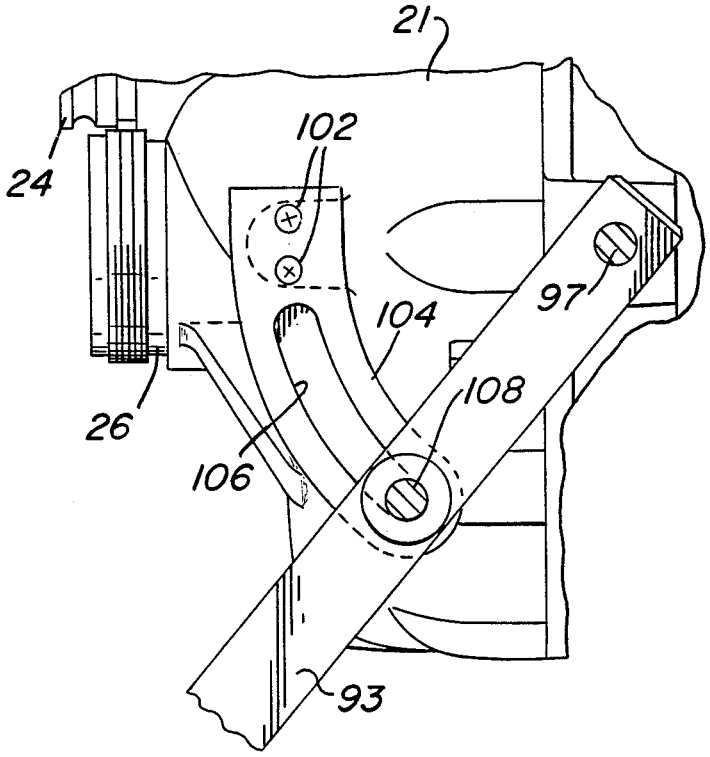
FIG. 11

WATER DRIVEN FAN FOR FIREFIGHTING

BACKGROUND AND SUMMARY OF THE INVENTION

This invention relates generally to the field of fans and, more particularly, to portable fans of the type used in firefighting applications by the use of positive pressure ventilation to help the firefighter both clear smoke from his path and fight the fire.

Positive pressure ventilation is a firefighting technique for removing heat and smoke from a fire area within a building or the like wherein clear air is directed into the building to produce a positive pressure therein by using fans, or blowers. This technique is becoming well known in the art and involves, by way of example, positioning the fan in or near a ground floor doorway of a house having a fire therein and breaking open a window at a desirable location on the other side of the fire, such as on the second floor. The fan is operated to blow air into the house to create what is called a "positive pressure" inside the house (typically a couple inches of water pressure) which pushes the smoke out. By the proper selection of the location of the exit opening and the direction of air flow from the fan, the clear air will flow from the doorway across the fire area to move smoke and heat away from the fire area so that it rises up and out of the house and away from the firefighters through the second floor opening provided.

There are two types of blowers in use today for this type of firefighting application; namely, electric blowers and gasoline-powered blowers. Electric blowers have the disadvantage that for portable construction the higher horsepower motors are too heavy and cannot provide the high power requirements for many applications. Further, the higher current required may not be available in an emergency situation. Also, electric blowers normally are limited in speed to 3600 RPM. Gasoline-powered blowers have the disadvantages that they are noisy, heavy, and introduce deadly carbon monoxide inside the structure where the fire is located.

In copending application Ser. No. 242,494, filed Sept. 12, 1988, and assigned to Hale Fire Pump Company, there is shown a fan system for firefighting by the use of positive pressure ventilation which obviates the problems of electric and gasoline-powered blowers in use today by providing a clean operation and by providing sufficient power with light weight and portability for firefighting applications.

It is the general object of this invention to provide a water driven fan of the indicated type which is an improvement over that disclosed in said copending application.

In furtherance of the general object of the invention, there is provided a portable fan driven by a water turbine capable of delivering air volume at more than 30,000 cubic feet per minute. The water driven fan in accordance with the invention requires no ignition, produces no exhaust, uses no electricity and eliminates the danger of sparking and the introduction of carbon monoxide into a building. Furthermore, the design in accordance with the invention can move a large amount of air in the safest way possible. Further, the design in accordance with the invention achieves a balance between efficiency and safety while offering the best performance with the lightest weight. The fan in accordance with the invention can be powered from any pumper with a tank, or from a hydrant, and can also be operated remotely from a fire truck. An actual embodiment comprises twelve polyamide fan blades, with the fan being 30 inches in diameter and being capable of providing sufficient pressure to ventilate several rooms simultaneously. This actual embodiment is lightweight and portable, weighing only 75 pounds and measuring only 35 inches high, 35 inches wide and 21 inches long. Moreover, there is provided a water mist means which provides exposure protection for the firefighter, decreases the energy of the fire, improves the heat transfer ability of the air and replaces oxygen with water vapor in the immediate vicinity of the fire.

Another feature of the invention is a novel inlet valve design whereby the inlet valve for the water is integrated into the main body of the turbine, and the valve member has a balanced action so that it is easy to open and move throughtout the flow controlling positions thereof.

Another feature of the invention is the arrangement of the inlet and outlet of the water flow to the turbine such that the inlet and outlet connections project in the same direction and opposite to the direction of the air flow. This arrangement allows the hoses to be positioned such that they form two trust absorbing legs of a tripod support for the unit during operation.

Another feature of the invention is the compact design of the water turbine which has a relatively small diameter. This small diameter construction reduces the weight of the unit and minimizes the blockage of air flow to the upstream side of the fan which results in a smoother and greater air flow.

Another feature of the invention is the provision of a novel carrying handle design whereby a single bar is configured to provide means for use in tilting or aiming the unit easily, easy access to handle portions for carrying or wheeling the unit, and safety protection against damage to the unit.

Another feature of the invention is the provision of a tilting support for the fan and turbine unit and means for locking the unit at a desired angular position about a pivotal support for the same to facilitate directing the air flow, for example, toward the center of the door opening.

Another feature of the invention is the provision of a novel "built-in" flow indicator design to provide an indication to the operator of the volume of air flow of the unit.

Another feature of the invention is the provision of a novel construction and arrangement of spray nozzles for introducing water into the air stream.

Other features of the invention relate to design safety of the unit. To this end, there are provided both plastic blades and a plastic shroud, which prevents the possibility of sparks even if rubbing should occur. Moreover, the turbine is constructed of a non-ferrous material which also prevents the possibility of sparks.

There is also disclosed a novel method and system for supplying recirculating water at high pressure in a closed loop system for the operation of a water driven fan or the like.

BRIEF DESCRIPTION OF THE DRAWINGS

FIG. 7 is a sectional view taken on line 7—7 of FIG. 5.

FIG. 8 is an enlarged, partially broken-away view of the area encircled in FIG. 6.

FIG. 9 is a sectional view taken on line 9—9 of FIG. 8.

FIG. 10 is a fragmentary view showing the air flow indicator for the fan in accordance with the invention.

FIG. 11 is a sectional view taken generally on line 11—11 of FIG. 3.

FIG. 12 is a detail view of a spray nozzle.

DETAILED DESCRIPTION OF THE PREFERRED EMBODIMENT

Figure 5:
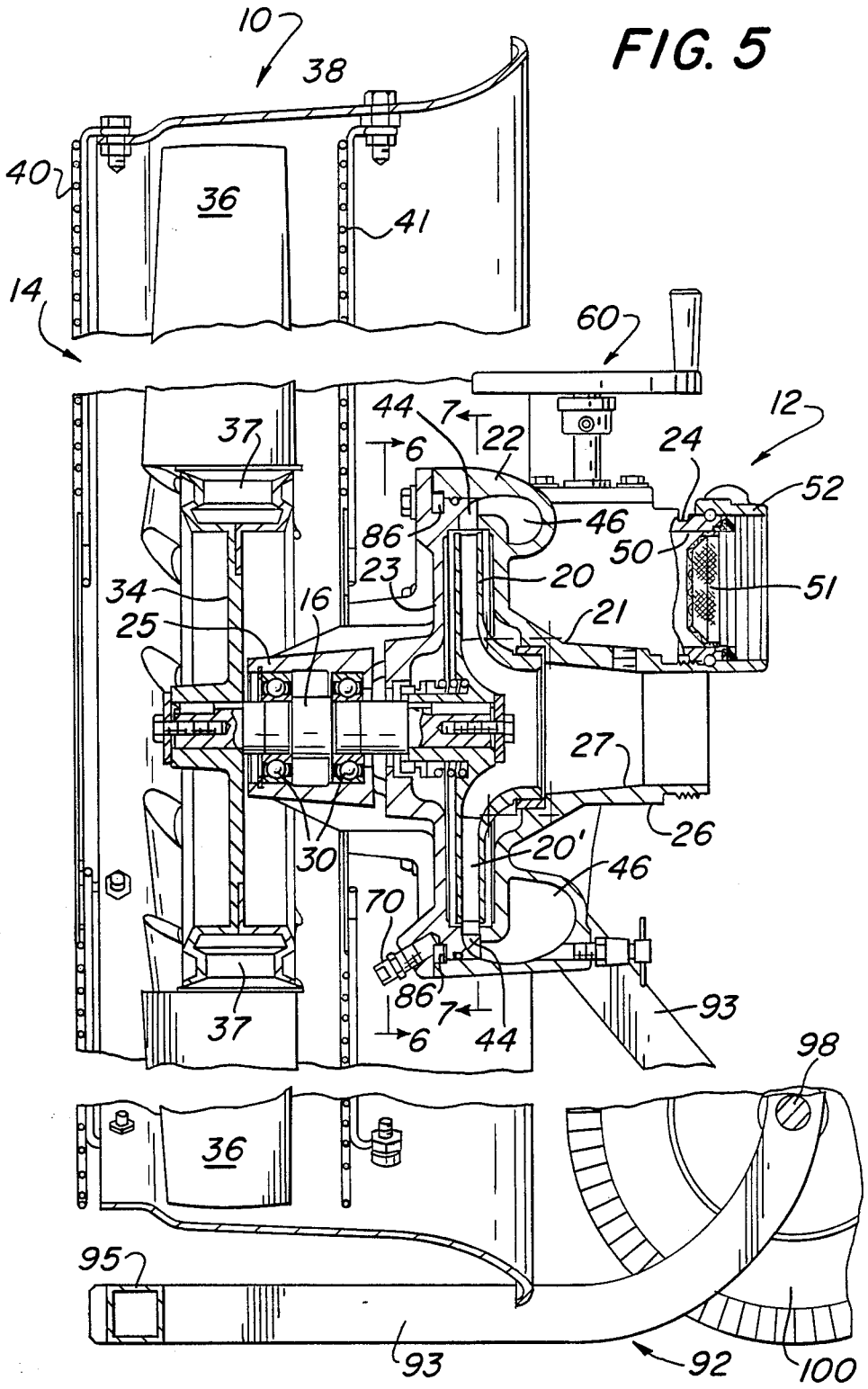
FIG. 5 is a sectional view, in elevation, of the fan shown in FIG. 1 with various parts eliminated for the sake of clarity of illustration.

Referring to the Drawings, the water driven fan in accordance with the invention comprises a fan and turbine unit 10 which includes a water powered turbine 12 constructed and arranged to drive a fan 14 by way of a common shaft 16. Turbine 12 comprises a runner 20 mounted on and keyed to one end of shaft 16 to rotate within the interior of a two-part turbine housing 22, which is provided with an inlet 24 and an outlet 26 for directing water into and out of housing 22. Turbine housing 22 comprises a rearwardly extending volute body 21 and a forwardly extending turbine head 23 which are connected together by bolts at mating surfaces suitably sealed by an 0-ring seal. Shaft 16 is rotatably supported at a medial portion by a pair of ball bearings 30 contained in head 23 of turbine housing 22 at a specially formed bearing housing portion 25 as is shown in FIG. 5. Turbine runner 20 is mounted on and keyed to the rearward end of shaft 16 by a conventional mounting arrangement shown in FIG. 5. Fan 14 comprises a hub or rotor 34 mounted on and keyed to the forward end of shaft 16 by a conventional mounting arrangement shown in FIG. 5. This construction and arrangement using a common shaft 16 eliminates the cost and other problems of providing a coupling between the turbine 12 and the fan 14.

Fan 14 is constructed to be a strong lightweight construction and has twelve fan blades 36 mounted on hub 34 at their bases 37 so as to extend radially outwardly from the axis of shaft 16 on a pitch angle of about 45–50 degrees. The fan blades 36 are contained within a shroud 38 and are enclosed by a pair of fan guards 40 and 41 formed of an open wire-like configuration as is shown in the Drawings.

Shroud 38 has a special shape whereby the air flow entering fan 14 is smoothly accelerated and the air flow leaving fan 14 is subjected to further acceleration to improve the control of the direction of the air flow. This specific construction is shown in detail in said prior-mentioned copending application. Briefly stated, the construction is such that in the direction of air flow through fan 14 the entry portion of shroud 38 is formed to converge gradually, the medial portion of shroud 38 is generally cylindrical and the exit portion of shroud 38, starting from the location where the air leaves the edges of the fan blades 36 on their outer diameter, converges in a nozzle shape. The diameter of the exit portion of shroud 38 at its downstream end is equal to or less than the outer diameter of the fan blades 36 as is shown in FIG. 5. By this arrangement, the air is smoothly accelerated as it comes into fan 14 and is subjected to further acceleration by the nozzle shape for improving the directional control of the air flow. This acceleration of the air flow reduces some of the vortexes in the air flow through fan 14 and provides a smooth flow of air delivered from fan 14 so that the fan 14 becomes directional so that the firefighter can direct the air flow more accurately.

A typical fan in accordance with the invention comprises a twenty (output) horsepower water turbine 12 operating at 1750–2000 RPM and a fan 14 having a 30-inch diameter. An actual embodiment of the fan in accordance with the invention is capable of delivering air volume at more than 30,000 cubic feet per minute. Moreover, the fan is portable in that it weighs only 75 pounds. Further, the fan is very compact in that its dimensions are 35 inches high, 35 inches wide and 21 inches long.

The lightweight construction results from the design which permits the use of a turbine 12 which is made of lightweight cast aluminum, a shroud 38 made of lightweight plastic, namely, ABS, and fan blades 36 made of a strong lightweight plastic material, namely, glass reinforced polyamide and a fan hub 34 made of cast aluminum.

A feature of the invention is the compact design of water turbine 12 such that it has a minimum diameter. This minimum diameter construction results in a reduction in the weight of the unit 10 and minimizes the blockage of air flow to the upstream side of fan 14 which results in a smoother air flow. To this end, there is utilized a radial-flow reaction turbine design whereby the turbine 12 comprises a stationary outer nozzle ring 42 which is arranged to deliver a high velocity, tangential water stream to the turbine vanes of runner 20 so that the water flow strikes the turbine vanes with an impulse force which is combined with the reaction force that is contained in the turbine runner 20 itself. In effect, the design is that of a combination impulse-reaction turbine which involves only one stage whereby it can be designed to be small, compact and light in weight. To this end, nozzle ring 42 is formed on the inner face of turbine head 23 and defines a plurality of guide vanes 44 so as to receive water flow from the volute chamber 36, which is defined in body 21 to extend circumferentially around the nozzle ring 42 to communicate therewith. The construction and arrangement of turbine 12 is such that volute passage 46 is located axially behind nozzle ring 42 and runner 20, as is apparent from FIG. 5. In a conventional radial turbine, the volute chamber is located radially outwardly of the runner 20. Since volute chamber 46 is behind runner 20, turbine 12 can be made of a minimal diameter so that volute chamber 46 does not take up any substantial radial space. Accordingly, as is apparent from FIG. 5, the turbine housing 22 has approximately the same outer diameter as the outer diameter of the hub 34 of fan 14. By reason of this construction, it is possible to achieve good, smooth air flow plus minimal noise. Any disturbance of the inlet flow to the fan adds to the noise which is objectionable.

Figure 3:
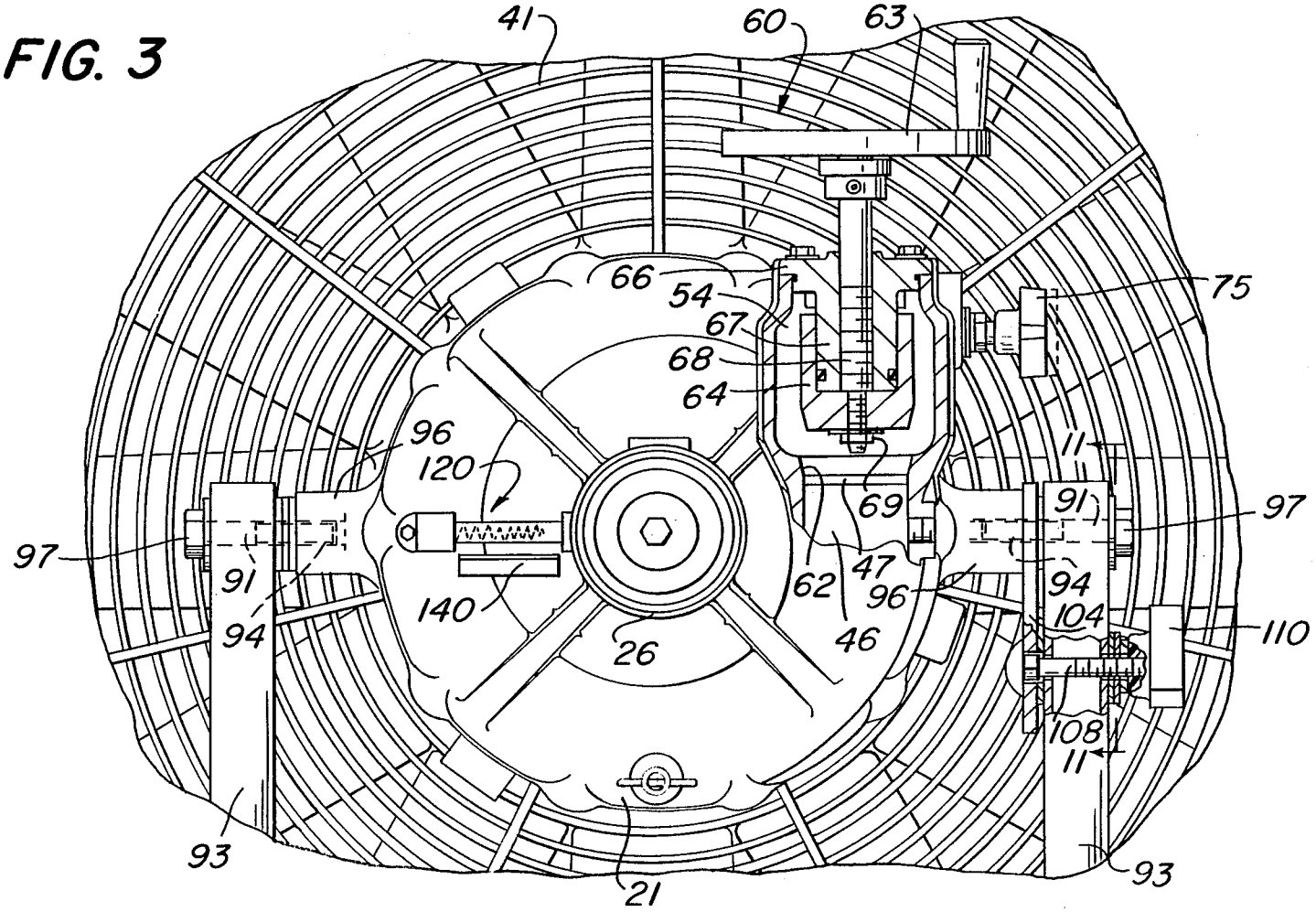
FIG. 3 is a fragmentary view taken from the rear of FIG. 1 and showing various details of the fan in accordance with the invention.

The design of the turbine 12 is such that the water flow to cause rotation of runner 20 and the operation of the fan 14 is as follows: The water enters the upstream end 47 of volute chamber 46 from an inlet chamber adjacent the inlet 24, as is best shown in FIG. 3. The water under pressure then flows through volute chamber 46 in a generally circular converging scroll-like path around the upstream end of nozzle ring 42 and the water will flow initially axially into the nozzle passages between guide vanes 44 and will then be turned radially inwardly into the turbine vanes 20' of runner 20 to cause the runner 20 to rotate. The water flows through runner 20 radially inwardly and is turned axially rearwardly to flow through the outlet 26 from which it is discharged from the unit 10. The rotation of runner 20 causes common shaft 16 to rotate thereby driving hub 34 and fan blades 36 to produce the air flow desired.

A feature of the invention is the design involving a novel inlet valve which is integrated into the volute body 21 of turbine housing 22 and includes a valve member having a balanced action. Another feature is the arrangement of the inlet 24 and outlet 26 of the water flow to and from turbine 12 such that they run in the same direction and opposite to the direction of air flow. This arrangement of the inlet 24 and outlet 26 allows the fire hoses to be positioned such that they help support the unit 10 during operation.

Figure 4:
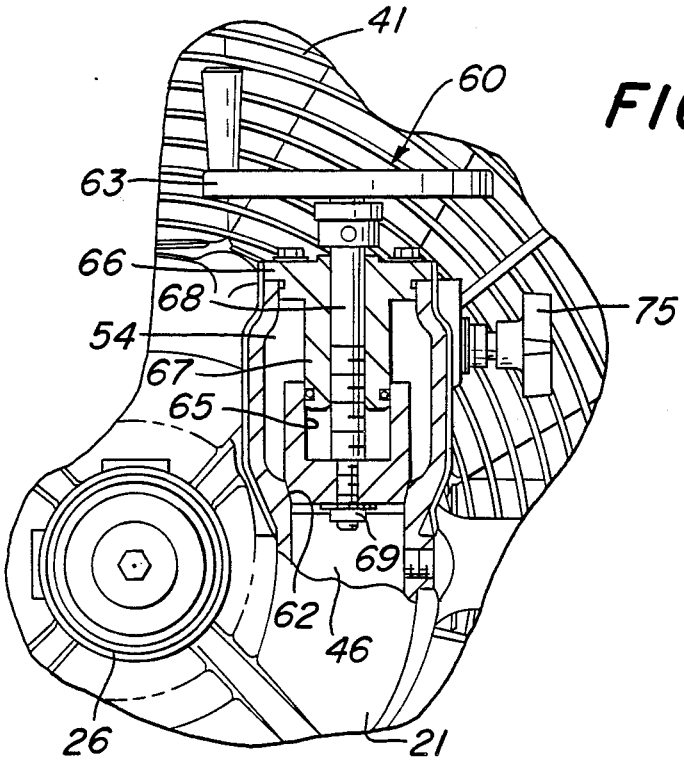
FIG. 4 is a fragmentary view showing the inlet valve of the fan in a closed position.

To this end, turbine inlet 24 comprises a hollow cylindrical portion 50 of turbine body 21 that extends along an axis parallel to the axis of shaft 16 in a rearward direction, i.e., a direction opposite to the direction of air delivery from the fan 10. Portion 50 has a strainer 51 located in a counterbore in its end. A female hose coupling 52 is rotatably attached on the end of portion 50 and is provided with internal threads for connection to the male coupling of a supply hose 53 shown in connected condition in FIGS. 1 and 2. Turbine body 21 defines an inlet chamber 54 (FIGS. 3 and 4) for receiving water under pressure delivered to the inlet coupling 52 by way of the supply hose 53 which is connected to a suitable pressurized water supply.

A flow control inlet valve means 60 is mounted in the turbine body 21 for controlling the flow of water from the inlet chamber 54 to the upstream end 47 of volute chamber 46. The flow control inlet valve means 60 includes a valve seat 62 at the upstream end 47 of volute chamber 46, a throttle valve member 64 cooperable with valve seat 62 for controlling flow therepast and means for mounting valve member 64 for movement toward and away from the valve seat 62. The mounting means for valve member 64 includes a cover 66 mounted on the turbine body 21, a valve stem 68 threadedly mounted in cover 66 and having valve member 64 mounted on the lower end thereof for movement therewith by means of a nut 69. A handle 63 is secured on the upper end of valve stem 68. Valve member 64 has a cylindrical recess 65 formed in the upstream side thereof and cover 66 has a plug portion 67 extending into inlet chamber 54 and sealingly received within recess 65, the seal being provided by means of an 0-ring seal carried by plug portion 67. This design minimizes the pressure area on the upstream side of valve member 64 to thereby provide a balancing of the pressures on the upstream and downstream sides of valve member 64. Thus, the operator of the fan unit 10 can turn handle 63 and move valve member 64 very easily to open valve means 60 and set the same at the desired flow control positions. It is particularly advantageous to be able to open the valve means 60 easily and this is achieved by means of the above-described balanced arrangement.

The turbine outlet 26 comprises a hollow cylindrical portion 27 of the turbine body 21 that extends along an axis parallel to and in alignment with the axis of shaft 16 and parallel to the axis of the turbine inlet cylindrical portion 50 as is shown in FIG. 5. The hollow cylindrical portion 27 also extends in the same direction as the inlet portion 50 i.e., rearwardly. The rearward end of the outlet cylindrical portion 27 has external male threads formed thereon to provide a coupling for connection to a female coupling of a return hose 55.

The above-described arrangement whereby the inlet and outlet hose connections extend rearwardly from the unit 10 provides a very advantageous design whereby the supply hose 53 and the return hose 55 can be connected to the unit 10 to extend rearwardly therefrom. The arrangement permits the operator to put the unit 10 as close to a doorway was possible during use because there is no need to leave clearance for the hoses 53 and 55. Furthermore, firefighting hoses are typically 2½ inches in diameter and will not bend on a very sharp radius, particularly when they are stiff, and instead will "kink" if they are bent too sharply. Furthermore, with the hoses 53 and 55 extending rearwardly from the unit 10, they can be placed on the ground to, in effect, act like a tripod support. In other words, one fire hose is bent to extend away from turbine 12 outwardly in one direction and the other hose is bent to extend away from turbine 12 in a diverging direction whereby the hoses themselves act like a supporting tripod to take up the reaction force (thrust) that is developed from the unit 10, i.e., the reaction force that wants to move the unit 10 rearwardly.

Figure 6:
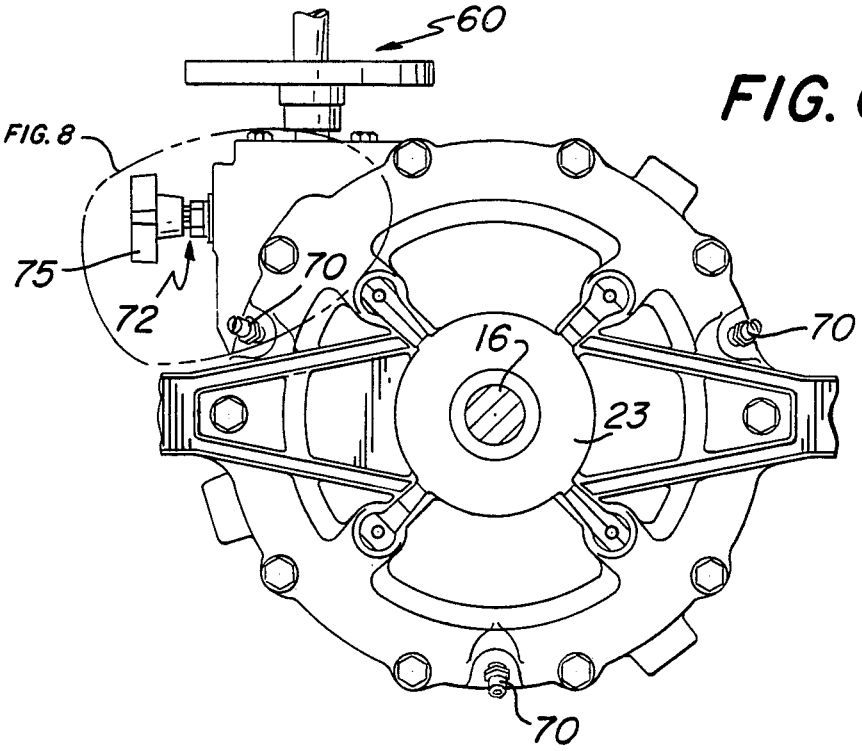
FIG. 6 is a sectional view taken on line 6—6 of FIG. 5.

A feature of the invention is the provision of a novel construction and arrangement of nozzles for introducing a spray of water into the air stream so that a water mist can be delivered to a fire. Such means comprises three spray nozzles 70 mounted at the periphery of turbine head 23 in a circumferentially equally spaced relationship, as is best shown in FIG. 6. The nozzles 70 are arranged to inject a small spray of water behind the fan blades 37 whereby a mist of water can be directed to the fire area by the firefighter during the fighting of a fire by positive pressure ventilation. Nozzles 70 each have an orifice opening 71 configured to dispense a flat, diverging (V-shaped) water spray and are oriented to direct these water sprays in planes extending transversely across a wide portion of the path of rotation of fan blades 36. There is provided means for supplying water to said spray nozzles, such means comprising a flow control valve means 72 for controlling the flow of water to the spray nozzles 70 and flow passage means for supplying water from the inlet chamber 54 to the upstream end of the inlet passage 73 of each spray nozzle 70. Referring particularly to FIGS. 6, 8 and 9, the valve means 72 comprises a rising stem plug valve 74 having a valve member 76 cooperable with a valve seat 78 which is in communication, at its upstream side, with the inlet valve chamber 54. From the downstream side of the valve seat 78 there is provided a horizontal passageway 80 which communicates at its downstream end with a short vertical passageway 82, which, in turn, communicates at its downstream end with a small, flat horizontally extending passageway 84. Passageway 84 communicates, at a small rectangular port with an annular passageway 86 between the body 21 and head 23 of the turbine housing 22. As is best shown in FIG. 9, each of the spray nozzles 70 is threadedly mounted in the head 23 in a bore 90 which communicates at its inner end with a part of annular passageway 86. The inlet passages 73 of each of the spray nozzles 70 communicate, at their upstream end, with an associated bore 90.

In order to inject a water spray behind the fan blades 36, the operator simply opens valve means 72. Valve means 72 is opened by turning the valve handle 75 attached on the outer end of a valve stem 77 on which valve member 76 is provided. This causes valve member 76 to move away from valve seat 78 so that water can flow from inlet chamber 54 therepast into passageway 80. The water flows sequentially through passageway 80, passageway 82 and passageway 84 into annular passageway 86. From passageway 86 the water flows into each of the bores 90 and each nozzle inlet passage 73 and is dispensed through the associated orifice openings 71 to be directed into the air stream at a location behind fan blades 36. The fan 14 directs the three water sprays as a fine mist along with the air flow delivered thereby.

A feature of the invention is the provision of a novel frame which provides a support for the unit 10 and means for locking the unit 10 at a desired angular position about a pivotal mounting for the same on the novel frame. To this end, there is provided a frame 92 which is made of a one-piece tubular construction including a pair of side arms 93 which are joined at their lower ends by a cross member 95. The side arms 93 have a generally upright straight portion extending from the upper end thereof to join a curved portion at the middle thereof and a bottom portion extending from the curved portion along the ground. At bores in their upper ends, the side arms 93 rotatably support a pair of axles 91 which are located to extend on a transverse horizontal axis and are received in hubs 96 formed on the turbine body 21 at diametrically opposed locations. The axles 91 are formed by the shank portion of mounting bolts 97 the threaded ends 94 of which are fixedly secured in an associated hub 96.

Side arms 93 have a transversely extending axle 98 extending through the curved portions thereof. At the outer ends of axle 98 there are mounted a pair of wheels 100 which are located on the outside of the side arms 93. Frame 92 thus has a pair of side arms 93 which extend rearwardly from the top end thereof at an angle to a curved portion and forwardly from the curved portion along the ground to cross member 95 to thereby provide stable support for unit 10. The wheels 100 provide a rolling support for unit 10 when it is desired to move the unit 10 along the ground.

In accordance with a feature of the invention, the transverse axis of the upper axles 91 is arranged to extend through the center of gravity of the fan and turbine unit 10. This provides for stability during use and transport of unit 10.

Figure 1:
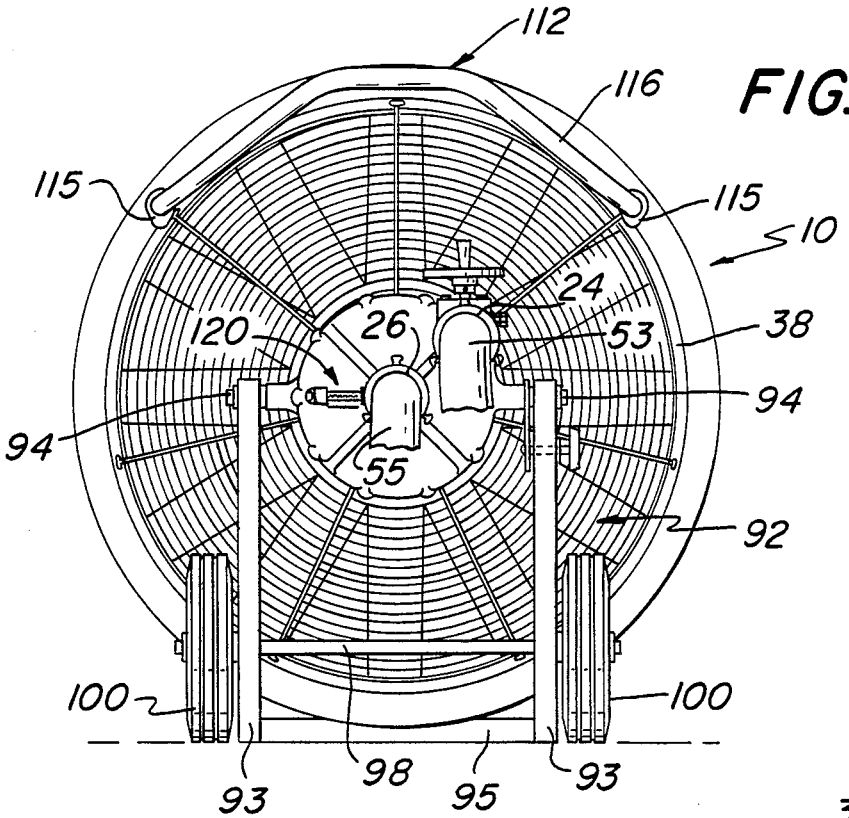
FIG. 1 is a rear elevational view of a water driven fan in accordance with the invention.
Figure 2:
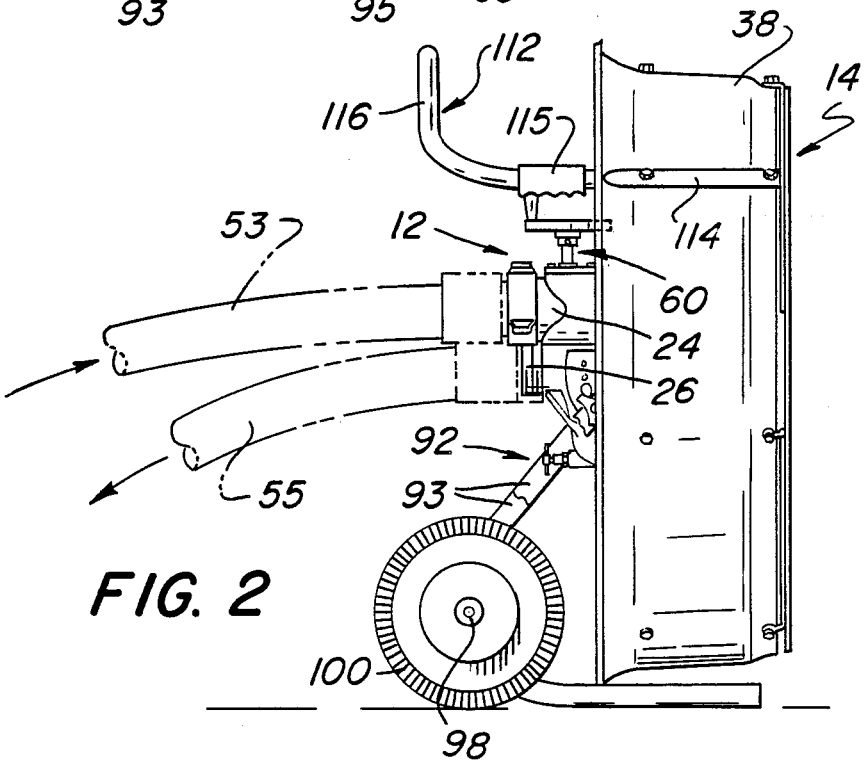
FIG. 2 is a right side elevational view of the fan shown in FIG. 1.
Figure 13:
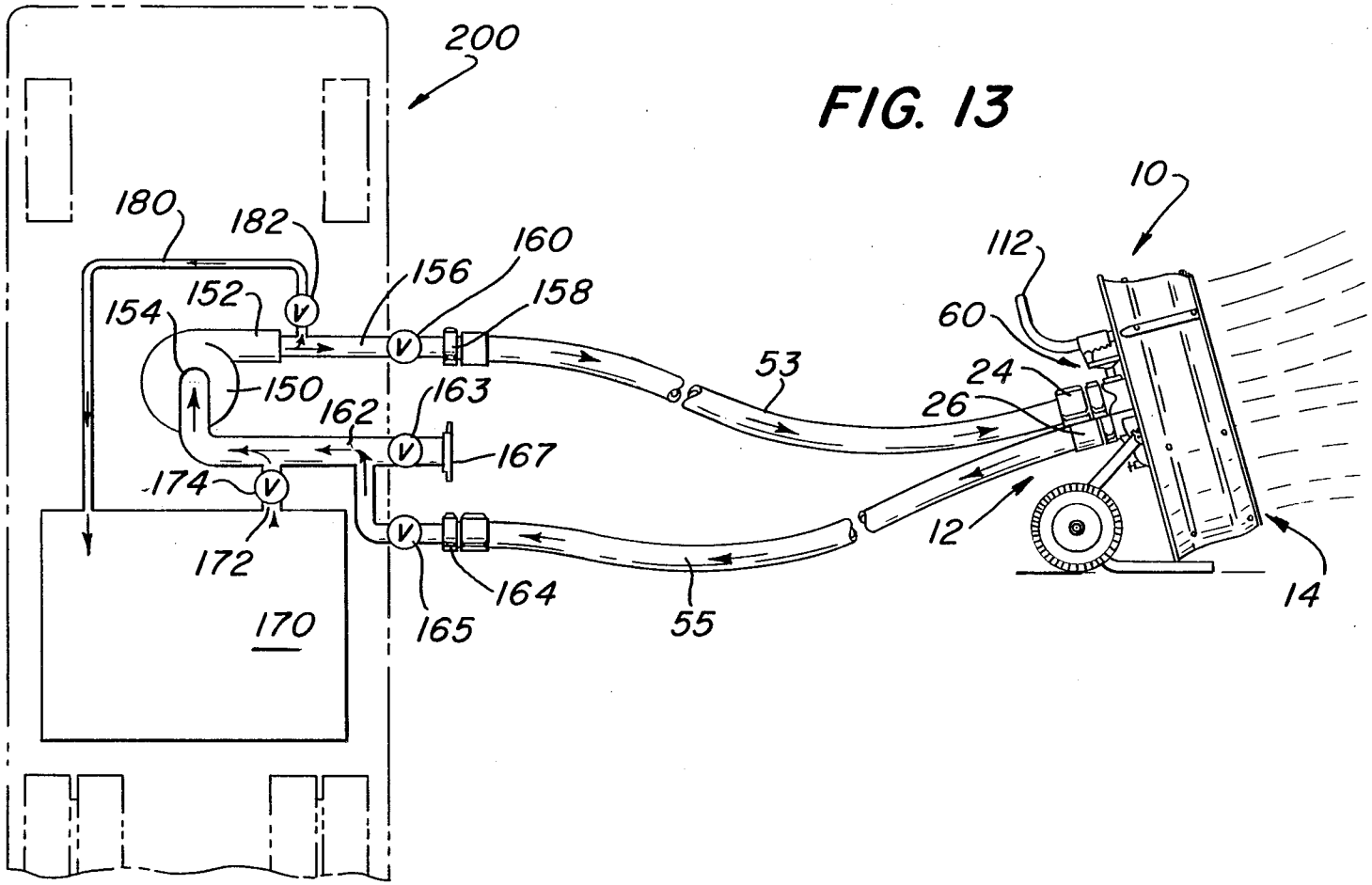
FIG. 13 is a schematic view of a system for supplying water to a water driven fan.

There is provided means for releasably locking unit 10 in a plurality of angular positions about the pivotal axis thereof provided by axles 91. To this end, body 21 has mounted thereon, by means of a pair of mounting bolts 102, a guide plate 104 having an arcuate slot 106 therein extending on an arc centered on the pivotal axis of unit 10 provided by axles 91. Plate 104 is positioned adjacent the upper portion of one of the side arms 93 as is shown in FIGS. 1, 3 and 11. A releasable locking means is mounted on one side arm 93 adjacent guide plate 104 and comprises a carriage bolt 108 received at its straight sided portion in arcuate slot 106. The shank portion of bolt 108 extends through a horizontal hole in side arm 93 and has its threaded end engaged with a handle 110. The parts are arranged so that handle 110 can be rotated to tighten plate member 104 in a frictionally secured position against the side arm 93 when desired. In this manner, it is possible to pivot unit 10 about its pivotal axis and lock the same in any desired angular position limited only by the cooperation between the bolt 108 and the slot 106 of guide plate 104. In FIG. 11, unit 10 is shown in its vertical position. However, it will be apparent that unit 10 can be pivoted in a counterclockwise direction, as viewed in FIG. 11, to various upwardly facing positions, such as shown in FIG. 13, for example. When the angular position is selected, unit 10 can be locked therein by turning handle 110 to frictionally secure side arm 93 of frame 92 and guide plate 104 together. As shown in FIG. 3, suitable friction washers are positioned between handle 110 and side arm 93 and between guide plate 104 and side arm 93.

Another feature of the invention is the provision of a novel carrying handle design whereby a single bar is configured like a handlebar to provide means for tilting or aiming the unit 10 easily, with easy access to handle portions for carrying or wheeling unit 10, and means providing safety protection against damage to the unit 10. To this end, a handle 112 is made of a single piece construction and is connected by bolts to the shroud 38 at a pair of end portions 114 which extend rearwardly from shroud 38 at circumferentially spaced apart locations thereof. Each end portion 114 has a hand grip 115 thereon for use in carrying unit 10. The single-piece handle 112 includes a second portion 116 which joins end portions 114 and extends in a radial plane spaced rearwardly from shroud 38. The top of portion 116 extends on an arc having a portion radially outwardly of shroud 38. The radial plane wherein portion 116 is located is positioned to be rearwardly beyond the turbine body 21 whereby handle 112 protects turbine 12 if unit 10 should fall over rearwardly.

Another feature of the invention is the provision of a novel "built-in" air flow indicator to provide a visual indication to the operator of the volume of free air flow being delivered by fan 14. To this end, there is provided a flow indicator 120 of the type disclosed in detail in U.S. Pat. No. 4,715,327. The flow indicator 70 is mounted on the turbine body 21 to extend horizontally by means of a mounting bolt 119 which cooperates with a mounting bracket 123 to secure an inlet end bonnet 121 to turbine body 21. Bonnet 121 defines an inlet chamber 122 which has an inlet port in flow communication with a passage 124 in body 21 leading to a part of volute chamber 46 and having a ranging orifice 125 therein. A transparent tube 127 extends horizontally from inlet bonnet 121 and has its downstream end received in and sealed within a bore 117 in the side of outlet 26 communicating with the outlet flow from turbine 12. The upstream end of tube 127 is also suitably sealed in inlet bonnet 121 as is shown in FIG. 10.

Transparent tube 127 provides a window through which the water flowing from volute chamber 46 to the outlet 26 can be visually observed. The flow indicator 120 comprises means for indicating the volume of the free air flow delivered by fan 14. Such means comprises an elongated coil spring 128 contained within tube 127 and having one end secured to a pin 129 fastened at the inlet end of tube 127 and having a free end adapted to move within tube 127 as spring 128 expands and contracts between a collapsed condition and a fully extended position shown in FIG. 10. Coil spring 128 is constructed with a selected spring rate whereby spring 128 can be expanded a substantial distance and an amount that is corrolated with the pressure differential between the inlet and outlet of flow indicator 120 which corresponds to the pressure differential across turbine 12 and the free air flow delivered by fan 14.

The air flow indicator means also comprises a ball 130 which is captured within the interior of the coils of spring 128. To this end, spring 128 has the coils at its free end wound into a tapered configuration to thereby capture the ball 130. The parts are arranged so that ball 80 assumes a set position within the free end of spring 128 in response to the drag force thereon provided by the flow of water through tube 127 from the inlet to the outlet ends thereof. Ball 130 is colored yellow, (or another bright color) so as to be clearly visible and is smaller in diameter than the inner diameter of tube 127.

Tube 127, spring 128, and ball 130 are constructed and arranged so that the water flow through the tube 127 from the inlet to the outlet ends thereof passes around ball 130 resulting in a drag force being applied to ball 130 causing it to move toward the outlet end of tube 127. This movement of ball 130 causes spring 128 to expand. The arrangement is such that ball 130 will assume a position which is indicative of the pressure differential between the inlet and outlet of tube 127 which corresponds to the volume of water flow through the turbine 12 and the rate of rotation of the turbine runner 20 and, therefore, the position of ball 30 corresponds to the rate of rotation of fan blades 36 and the volume of free air being delivered by the fan 14. A scale 140 is mounted on body 21 adjacent tube 127 and is provided with indicia to indicate the volume of air flow in CFM as is shown in FIG. 10. Ranging orifice 125 is sized so that ball 130 will move within tube 127 and across the indicia on scale 140 during the normal range of operation of turbine 12.

Another feature of the invention is the provision of a closed loop system for supplying water at high pressure for the operation of the turbine and fan unit 10 which system can be operated by a novel method. An object of the system and method is to minimize the heat buildup of the water circulating in the closed loop supply system. A feature of this closed loop system is that the water supply to the unit 10 is a relatively small amount and said supply can be contained in the water tank provided on a typical fire truck. Further, by the use of a recirculating conduit means cold water is added to the recirculating loop from the supply tank to minimize the rate at which the temperature rise of the water circulating in the closed loop occurs.

The system is disclosed in FIG. 13 and comprises a supply hose 53 connected at its downstream end to the inlet 24 of turbine 12, a return hose 55 connected at its upstream end to the outlet 26 of turbine 12. The high pressure water supply includes a high pressure pump 150 having a discharge 152 and a suction 154. By way of example, pump 150 may comprise a midship fire truck pump manufactured by Hale Fire Pump Company and capable of delivering from 750–2000 gallons per minute at pressures up to typically 300 PSI while being driven from the engine of a typical fire truck 200. There is also provided a first conduit means 156 for delivering water from discharge 152 of pump 150 to a discharge fitting 158, which has the upstream end of the supply hose 53 coupled thereto. A pump discharge valve 160 is connected in the conduit means 156 to control flow therethrough. Discharge valve 160 is typically a ball valve which has some throttling capability. The system includes a second conduit means 162 for delivering water from the downstream end of return hose 55 to the suction of pump 150. Conduit means 162 has two branches, one of which has a pump inlet valve 165 connected therein and terminates at a suction fitting 164 coupled to return hose 55. The other branch of conduit means 162 terminates at a suction tube cap 167 and has a butterfly valve 163 connected therein to control flow therethrough. Valve 165 is typically a ball valve. Pump 150 and the conduits 156 and 162 are typically made as all part of the same casting and are mounted on the fire truck 200 adjacent to a supply tank 170 on the fire truck 200 and known in the art as a "booster tank". A third conduit means 172 is connected between supply tank 170 and conduit means 162 and has a tank valve 174 connected therein for controlling flow from tank 170 to a portion of conduit means 162 downstream of valves 163 and 165.

A fourth conduit means 180 is connected between conduit means 156 and the supply tank 170 and has valve 182 connected therein for controlling flow therethrough.

The above-described arrangement of pump 150 and conduit means 156, 162 and 180 is provided on many fire trucks; however, they are used in a conventional way to supply water to fire hoses, draw water from other fire trucks or hydrants, relay water from one fire truck to another, etc. and have not been used to drive water driven devices like unit 10.

In accordance with the novel method and system of the invention, the system shown in FIG. 13 is operated as follows. The first thing the firefighters do upon the arrival at a fire scene with a fire truck 200 having its tank 170 filled with a volume of water is to position the unit 10 and hook up the supply hose 53 and return hose 55 between the inlet 24 and outlet 26 of the unit 10 and the discharge fitting 158 and suction fitting 163 in the arrangement shown in FIG. 13. During this hook-up procedure all the valves 160, 163, 165, 174 and 182 on the fire truck 200 are positioned in their closed position. In the use of the system with a fan and turbine unit 10, the inlet valve 60 on the unit 10 is initially positioned in the closed position. In this case, the valves 160, 165, 174 and 182 are then opened in any desired sequence. Preferably valve 165 should be opened first to prevent excessive pressure buildup in the return line. Then, when pump 150 is brought to an operating condition and the inlet valve 60 of unit 10 is opened, the water will flow through a closed loop system as shown by the arrows in FIG. 13. In some cases it may be desirable to open the pump discharge valve 160 last and use it to achieve a throttling control of the water flow. This would be achieved in combination with the throttle of the fire truck engine that drives pump 150 and is conventional procedure used by firefighters.

The system will now operate in a novel manner to provide a recirculating closed loop water supply to the turbine 12 and to operate unit 10 with a quantity of water such as is carried by tank 170 of a conventional fire truck. In addition, by reason of the secondary recirculating flow of water through conduit means 180 from the discharge 152 of the pump 160 back to the supply tank 170, low temperature water will be continually added to the closed loop through conduit means 172 and tank valve 174. This secondary recirculating flow serves to moderate the rate of temperature rise of the water flowing through the closed loop system during operation to a rate which will prevent damage to the pump 150, the turbine 14 and the other components in the closed loop system.

It is to be noted that the system shown in FIG. 13 is applicable to various types of water-powered devices other than the turbine and fan unit 10, such as for example, other types of water turbine or water motor driven fire-fighting and rescue equipment.

What is claimed is:

1. A water driven fan for use in positive pressure ventilation in the fighting of fires comprising:

a fan and turbine unit including a fan means including a shaft mounted for rotation, a hub secured to said shaft and a plurality of fan blades mounted on said hub to rotate therewith and to extend radially therefrom, and a water powered turbine for driving said fan means including a housing having an inlet, a volute and an outlet for directing the water driving said turbine, said turbine housing defining an inlet chamber for receiving water under pressure delivered from a pressurized source to said turbine inlet and a volute chamber communicating with said inlet chamber, and a flow control valve means mounted in said turbine housing for controlling the flow of water from said inlet chamber to said volute chamber.

2. A fan according to claim 1 wherein said flow control valve includes a valve seat at the downstream end of said inlet chamber, a valve member cooperable with said valve seat for controlling flow therepast, and means for mounting said valve member for movement toward and away from said valve seat.

3. A fan according to claim 2 wherein said means for mounting said valve member includes a cover mounted on said turbine housing, a valve stem threadedly mounted in said cover, said valve member being mounted on the end of said valve stem for movement therewith, said valve member having a recess formed in the upstream side thereof, said cover having a plug portion extending into said inlet chamber and sealingly received within said recess in said valve member to minimize the pressure area of the upstream side of said valve member thereby providing a balancing of the pressures on the upstream and downstream sides of said valve member.

4. A water driven fan for use in positive pressure ventilation in the fighting of fires comprising:

a fan including a shaft mounted for rotation and a plurality of fan blades mounted on said fan shaft to rotate therewith and to extend radially therefrom, and a water powered turbine for driving said fan including a housing having an inlet, a volute and an outlet for directing the water driving said turbine, said inlet having means forming a supply hose connection facing in a rearward direction opposite the direction of air flow produced by the fan, said outlet having means forming a discharge hose connection facing in a rearward direction opposite the direction of air flow produced by the fan whereby supply and discharge hoses can be connected to the turbine housing so as to extend away from the fan in a direction opposite the direction of air flow produced by the fan.

5. A water driven fan for use in positive pressure ventilation in the fighting of fires comprising:

a fan including a shaft mounted for rotation and a plurality of fan blades mounted on said fan shaft to rotate therewith and to extend radially therefrom, and a water powered turbine for driving said fan including a housing having an inlet, a volute and an outlet for directing the water driving said turbine, and turbine housing defining an inlet chamber for receiving water under pressure delivered from a pressurized source to said turbine inlet and a volute chamber communicating with said inlet chamber, said turbine including a runner mounted for rotation about an axis and having a plurality of turbine vanes extending radially from said axis, said housing defining said volute chamber in a region axially behind said turbine vanes.

6. A fan according to claim 5 wherein said fan includes a central hub from which said fan blades extend radially outwardly, said volute chamber having an outer diameter approximately equal to or less than the diameter of said central hub.

7. A water driven fan for use in positive pressure ventilation in the fighting of fires comprising:

a fan means including a shaft mounted for rotation, a hub secured to said shaft and a plurality of fan blades mounted on said hub to rotate therewith and to extend radially therefrom, a water powered turbine for driving said fan means including a housing having an inlet, a volute and an outlet for directing the water driving said turbine, said turbine housing defining an inlet chamber for receiving water under pressure delivered from a pressurized source to said turbine inlet and a volute chamber communicating with said inlet chamber, and a plurality of spray nozzles in said housing constructed and arranged to inject a small spray of water behind said fan blades whereby a mist of water can be directed to the fire area by the fire-fighter during the fighting of the fire by positive pressure ventilation and means for supplying water to said spray nozzles.

8. A fan according to claim 7 including a spray nozzle flow control valve means for controlling the flow of water supplied to said spray nozzles, and including flow passage means for supplying water from said inlet chamber to the upstream end of said spray nozzle flow control valve means.

9. A fan according to claim 8 including passage means for supplying water from the downstream end of said spray nozzle flow control valve to each of said plurality of spray nozzles, said passage including an annular passage extending around said turbine housing.

10. A fan according to claim 1 wherein said shaft is constructed and arranged to provide a common drive-shaft between said turbine and said fan, said turbine including a runner keyed on one end of said shaft, and said fan hub being keyed on the other end of said shaft.

11. A fan according to claim 1 wherein said fan includes a shroud-like housing extending around the outer edges of said fan blades, said shroud-like housing and said fan blades both being made of a strong plastic material.

12. A fan according to claim 11 wherein said turbine includes a body made of cast aluminum.

13. A fan according to claim 1 including a shroud-like housing extending around the outer edges of said fan blades, and a handle connected to said shroud-like housing and having a pair of first portions extending rearwardly from said shroud-like housing at diametrically opposed locations thereof and a second portion joining said pair of first portions and extending in a radial plane spaced rearwardly from said shroud-like housing and on an arc approximately equal to the periphery of said shroud-like housing.

14. A fan according to claim 13 wherein said handle is made of a single piece construction and said radial plane of said second portion of said handle is rearwardly beyond said turbine housing whereby said handle protects said turbine and fan against damage.

15. A fan according to claim 1 including a one-piece frame supporting said fan and turbine unit and having a pair of wheels mounted thereon so as to provide a rolling support for said unit.

16. A fan according to claim 15 including means for mounting said unit on said frame to pivot about a transverse axis, said transverse axis extending through the center of gravity of said unit whereby said unit can be pivoted easily to various angular positions.

17. A fan according to claim 16 including means for releasably locking said unit in a plurality of said angular positions.

18. A fan according to claim 1 including conduit means for delivering water from a part of said volute chamber to a location adjacent the outlet of said turbine, and a flow indicator means connected in said conduit means for indicating the volume of free air flow delivered.

19. A fan according to claim 18 wherein said flow indicator comprises a transparent flow tube through which said water flows in the direction from said volute chamber to said outlet, a coil spring having one end secured at one end of said flow tube and a free end contained within said flow tube, and an indicator member captured within said free end of said spring, said water flow through said flow tube applying a force to the indicator member to move the same and extend said spring.

20. A fan according to claim 19 wherein said coil spring is constructed and arranged to resist the movement of said indicator member to bias the same toward a position near said one end of said flow tube, said spring being expandable from a collapsed condition near said one end of said flow tube to allow said ball to move a substantial distance away from said one end of said flow tube and including a scale adjacent said flow tube displaying indicia representing the free air flow delivered by the fan, the parts being constructed and arranged so that said indicator member assumes a position to indicate the volume of free air being delivered by said fan in response to the pressure differential between the inlet and outlet of said turbine.

21. A fan according to claim 1 including a frame supporting said fan and turbine unit, means mounting said unit on said frame to pivot about a transverse axis to various angular positions, and handle means secured to said unit for directing the position of said frame and for tilting said unit to a desired angular position.

22. A method of supplying water at high pressure to a water-driven device having an inlet and an outlet by means of a system including a high pressure pump having a discharge and a suction, a supply tank containing a volume of water, first conduit means for delivering water from said pump discharge to a discharge fitting, second conduit means for delivering water from a suction fitting to a suction of said pump, third conduit means connected between the said supply tank and said second conduit means for delivering water from said tank to said pump suction, and fourth conduit means connected between said first conduit means and said supply tank for recirculating water from said first conduit means to said supply tank, said method comprising maintaining said first, second, third and fourth conduit means open to flow, connecting said discharge fitting to the inlet of said water-driven device by a supply hose, connecting the outlet of said water-driven device to said suction fitting by a return hose to provide a closed loop system, and operating said pump to deliver water at high pressure through said closed loop system including said first, second and third conduit means and said supply and return hoses and recirculating some liquid through said fourth conduit means back to said tank to minimize the temperature rise of the water circulating through said closed loop system.

23. The method according to claim 22 wherein said pump, said supply tank and each of said conduit means is mounted on a vehicle such as a fire truck or the like.

24. A method according to claim 23 wherein said water-driven device comprises a portable water-driven fan including a water-driven turbine having an inlet and an outlet, said supply and return hoses being connected to the inlet and outlet of said water-driven turbine.

* * * * *